US005628397A

United States Patent [19]

Ham

[11] Patent Number: 5,628,397

[45] Date of Patent: May 13, 1997

[54] GARMENT BAG WITH CYLINDER-SHAPED PACKING COMPARTMENTS

[75] Inventor: Soojung Ham, Providence, R.I.

[73] Assignee: Samsonite Corporation, Denver, Colo.

[21] Appl. No.: 397,524

[22] Filed: Mar. 2, 1995

[51] Int. Cl.[6] ..... A45C 3/00; A45C 5/12

[52] U.S. Cl. ..... 206/287.1; 206/292; 190/110; 190/111; 190/13 C

[58] Field of Search ..... 206/278, 279, 206/289, 287, 287.1, 292; 190/109, 110, 111, 13 C

[56] References Cited

U.S. PATENT DOCUMENTS

| | | | |
|---|---|---|---|
| 1,651,706 | 12/1927 | Holbrook | 206/289 X |
| 1,760,098 | 5/1930 | Wilt | 206/292 |
| 2,002,638 | 5/1935 | Lee et al. | 206/289 |
| 2,138,202 | 11/1938 | Wilt | 206/292 |
| 2,296,080 | 9/1942 | Arrowood | 206/287.1 X |
| 2,362,807 | 11/1944 | Dresner | 206/292 X |
| 2,422,511 | 6/1947 | Wolsey | 206/292 |
| 2,423,297 | 7/1947 | Creamer | 206/287.1 X |
| 3,128,854 | 4/1964 | Specht | 206/289 |
| 3,315,772 | 4/1967 | Katz | 206/287.1 |
| 4,170,282 | 10/1979 | Schwartzstein | 206/287.1 |
| 4,598,803 | 7/1986 | Ghiassi | 190/108 |
| 4,693,368 | 9/1987 | King et al. | 190/36 X |
| 4,736,839 | 4/1988 | King | 206/287.1 |
| 4,753,342 | 6/1988 | Pulichino, Jr. et al. | 206/287.1 |
| 4,927,014 | 5/1990 | Pulichino, Jr. | 206/287.1 |
| 4,998,603 | 3/1991 | Nortstrom | 206/289 X |
| 5,255,766 | 10/1993 | Deconinck | 206/36 |
| 5,505,297 | 4/1996 | Myers | 206/287.1 X |

*Primary Examiner*—Sue A. Weaver

*Attorney, Agent, or Firm*—Gregory W. O'Connor

[57] ABSTRACT

Garment bags have been designed to carry garments on hangers, but have resulted in varying capabilities to help resist wrinkling these hanging garments during transport and storage. Disclosed is a garment bag with an arrangement of auxiliary pockets and compartments to help resists wrinkling. Specifically, one or more generally semi-cylindrical shaped pockets extend across the width dimension of the main packing compartment of the garment bag. When the bag is packed and folded in its transport configuration, the hanging garments fold or drape around these packed cylinder shaped compartments thus the garments are less likely to wrinkle.

4 Claims, 2 Drawing Sheets

GARMENT BAG WITH CYLINDER-SHAPED PACKING COMPARTMENTS

BACKGROUND OF THE INVENTION

This invention relates to garment bags, a popular form of travel luggage which generally comprises a main packing compartment for receiving garments on hangars and a carrying strap or handle for carrying this large packing compartment in a folded condition. Usually these garment bags have auxiliary pockets built into and protruding from the outward facing cloth panel (the surface forming the outside of the bag when being carried by its handle or shoulder strap) or on the main access panel opposite from the front panel. The access panel opens wide to permit access to the main packing compartment. These garment bags are easy to pack and easy to unpack. They often permit the traveller to "live out of" the garment bag since a traveller can have ready access to their hanging garments, while keeping them stored in the main packing compartment.

A constant problem for the traveller and one that many have tried to solve with varying degrees of success is the problem of keeping at least the hanging garments neat and relatively unwrinkled. Unlike hard-sided luggage with its rigid shells to protect the garments contained therein, garment bags generally will constrain the garments in a hopefully unwrinkled position. So constrained, the garments can be carried with the hope that the garments will not become rumpled in the process.

One prior art garment bag is shown in U.S. Pat. No. 4,736,839. Here, the garments are arranged in a bag in the usual fashion, but the access panel constitutes the main or front panel of the garment bag because it has the carrying handle and strap positioned in the middle of this access panel. Accordingly, the user need only arrange the hanging garments in the main packing compartment, close this access panel, and fold the garment bag into the carrying condition by folding the two halves together. This causes the garments on hangers to be folded backward, placing the fronts of the garments in tension and around a fairly large radius defined by the back panel of the bag and garments behind each of the garments at the fold location.

Another garment bag is shown in U.S. Pat. No. Des. 286,230. Here, an auxiliary packing compartment is hung on the outside surface of the main packing door to help the traveller organize the inevitable small items of clothing and travel accessories.

However, none of the prior art garment bags arrange these auxiliary packing compartments in the main hanging garment packing arrangement to help the user to hold the hanging garments in a folded condition to minimize wrinkling, especially wrinkling along the main fold area.

BRIEF DESCRIPTION OF THE INVENTION

Accordingly, disclosed is a garment bag with a main packing compartment to receive hanging garments. This garment bag has an overall width adequate to accommodate these hanging garments. The main packing compartment includes a means for holding the hangers and an access panel by which the garments on hangers are placed into the main packing compartment for transport. The improved garment bag comprises at least one cylinder-shaped packing compartment which is at least partially contained in this main packing compartment and positioned to engage the hanging garments. This cylinder-shaped compartment has an axial dimension extending across the width dimension on a garment bag. This cylinder-shaped packing compartment has a circumference dimension large enough to accommodate at least small pieces of clothing and having a selectively openable slit through which a small piece of clothing may be inserted for transport.

To take best advantage of this construction, the cylinder-shaped packing compartment extends across the approximate mid point of the height dimension of the garment bag, that is the location where the garment bag is folded for transport by the provided handle or shoulder strap.

To accommodate longer garments, the garments that would normally extend below the bottom-most portion of the main packing compartment when hung on hangers, the garment bag can be provided with a long garment retaining panel. A second cylinder-shaped packing compartment is provided to extend across a lower portion of the main packing compartment and releasably attached to the main packing compartment to permit clothing to be placed between the cylinder-shaped packing compartment and the lower portion of the main packing compartment. In this manner, clothes packed in the main packing compartment which are longer than the height dimension of the main packing compartment can have their lower portions looped around this second cylinder-shaped packing compartment.

DETAILED DESCRIPTION OF THE PREFERRED EMBODIMENT

Figure 1:
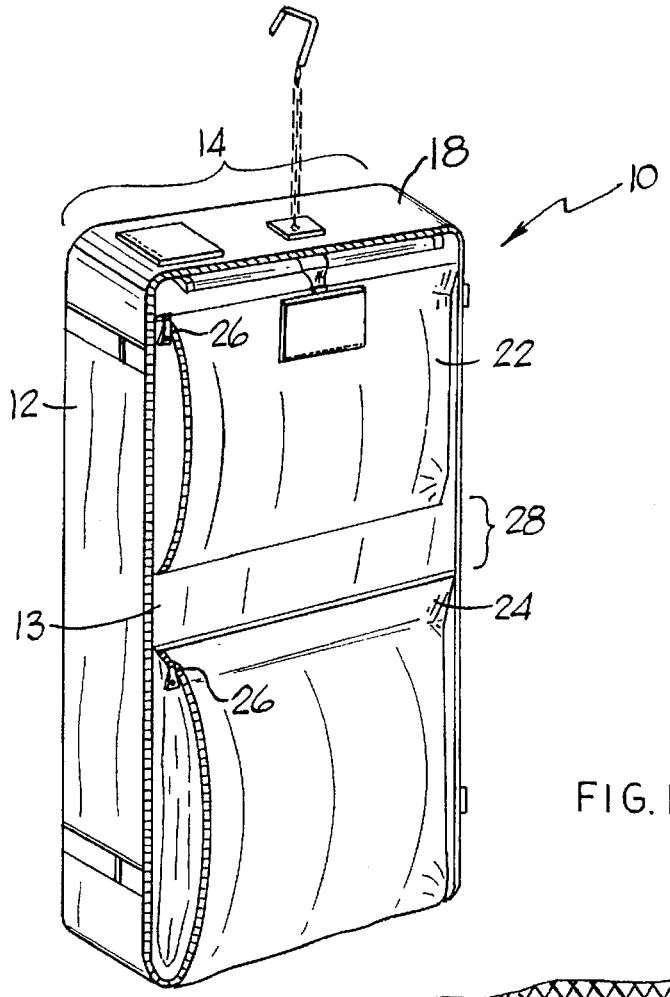
FIG. 1 shows a perspective view of a garment bag according to the instant invention.

Referring to the figures, garment bag 10 is of generally conventional construction. Its main feature is the main packing compartment 12 defined between the access panel 13 and a front panel 15 to which conventional carrying devices 17 such as a shoulder strap and a handle grip are attached across a central portion of this front panel 15. The main bulk or volume of the main compartment is defined by gussets 18 which surround the generally elongated rectangular shape between the front panel 15 and the access panel 13. Within the main packing compartment, there is a hanger retainer 16 of conventional type. As is well-known, such devices grip or receive the hook portions of various types of hangers or otherwise support the hangers with clothes depending therefrom.

FIG. 1 shows an upper pocket 22 and a lower pocket 24 attached to and forming the major portion of the outside face of the main access panel 13. These pockets are supported on the access panel and the access panel is in the closed position with slide fastener 20 releasably sealing three of the four generally straight edges around its overall rectangular plan area. The right-most edge of the panel 13 has a conventional cloth hinge attaching it permanently to the corresponding edge of the associated gusset. Each of the upper pocket 22 and lower pocket 24 has itself a slide fastener 26 positioned along at least one side thereof to permit small items of clothing such as folded shirts and sweaters, etc. to be packed therein.

Figure 2:
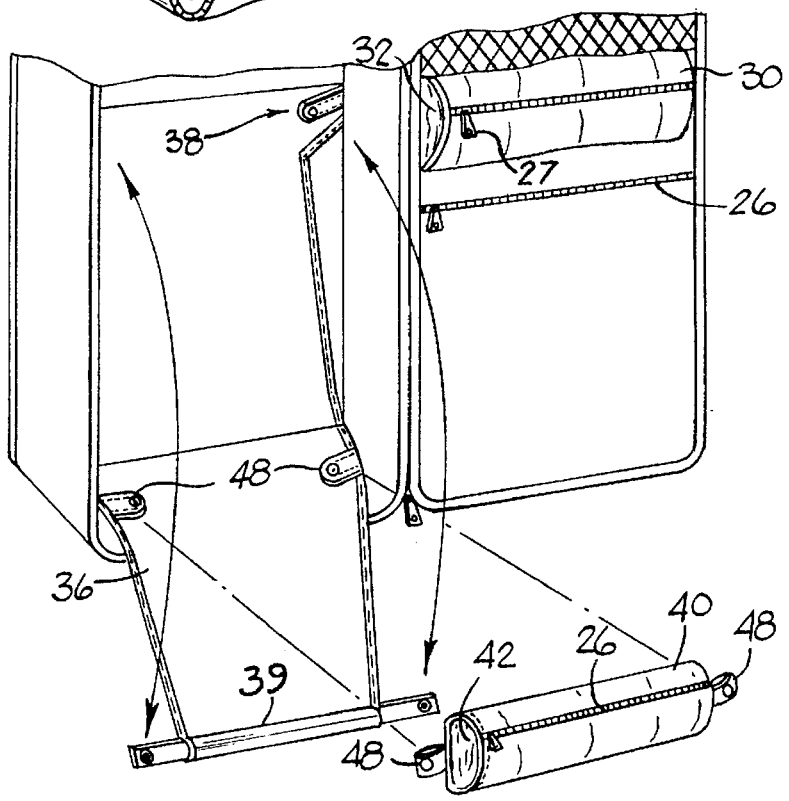
FIG. 2 shows a lower portion of the garment bag in FIG. 1 in the open position.
Figure 3:
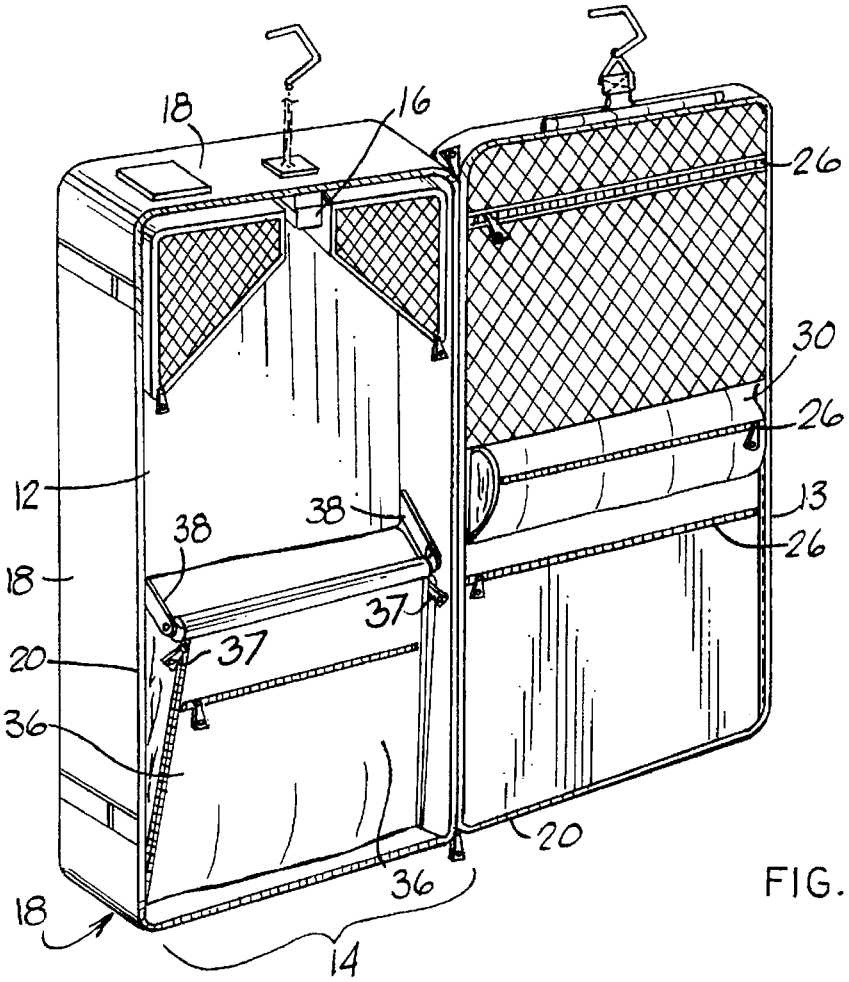
FIG. 3 shows the garment bag of FIG. 2 in a partially closed condition.

FIG. 3 shows the inside of the main packing compartment and access panel 13 with the further slide fasteners 26 to permit access to the pockets 22 and 24 when the garment bag is open to the user. Significant to the instant invention is the arrangement of these pockets and a cylinder-shaped compartment 30. As can be seen on the inside of panel 13 in FIGS. 2 and 3, the cylindrical-shaped pocket protrudes a substantial distance towards and into the main packing compartment. This is so because a pair of side gussets 32 define a substantially semi-cylindrical shape with the flat side of the thus semi-cylinder shaped compartment 30 being defined by the main access panel and this smoothly curving front surface protruding along its cylindrical shape into the main packing compartment. An access slide zipper 27 is shown extending across the full width of the cylinder-shaped pocket 30. This compartment 30 extends across the width 14 of the main packing compartment. Note the upper pockets 22 and lower pocket 24 are arranged on panel 13 to define a gap 28 which substantially corresponds to the height dimension of the cylinder-shaped compartment 30 on the opposite side of the panel 13.

Preferably, the garment bag 10 should be provided with a means 36, etc. for controllably constraining especially long garments. The height dimension of the main packing compartment is usually adequate to suspend coats, pants and skirts on hangers. However, especially long garments such as trench coats or a woman's formal evening wear will, of necessity, extend beyond the lowermost portion of the main packing compartment when suspended from the hanger support 16. For this reason, it is conventional to provide an elongated panel which is self-hinged from the lowermost portion of the packing compartment, together with some means such as elastic straps for holding at least the lowermost portion of such long garments against this panel. Here, a different sort of long garment panel 36 is shown. The main panel 36 is an unstructured cloth panel. At its attachment point to the main packing compartment are provided attaching straps 38 which are intended to releasably attach a further cylinder-shaped packing compartment 40 having side gussets 42 similar to gussets 32 of compartment 30. Note at its lowermost end (uppermost when in the stored position shown in FIG. 3), the panel 36 includes elastic fastening straps 38 which are releasably interconnected to hold the panel 36 into its packed condition shown in FIG. 3. It is significant to note that these releasable attaching straps 38 are positioned to hang downwardly to place the uppermost edge of 36 (which preferably contains a stiffening plastic tube 39) at a position just below the lower edge of the first cylinder-shaped packing compartment 30 when the access panel 13 is closed and zipped. The second cylinder-shaped packing compartment 40 is obviously completely removable. This permits the user to place the long garments in the main packing compartment and along the forward facing surface of the packing panel 36.

The operation of the preferred embodiment will now be outlined. As in a conventional garment bag, garments on hangers are fastened into the main packing compartment 12 by attaching the hooked portion of the hangers to the hanger support 16. Other garments are packed as usual in the various pockets in compartments provided in the usual manner and will not be further detailed here. The cylinder-shaped compartments 30 and 40 are important and central to this invention, so further detail will be justified.

Figure 4:
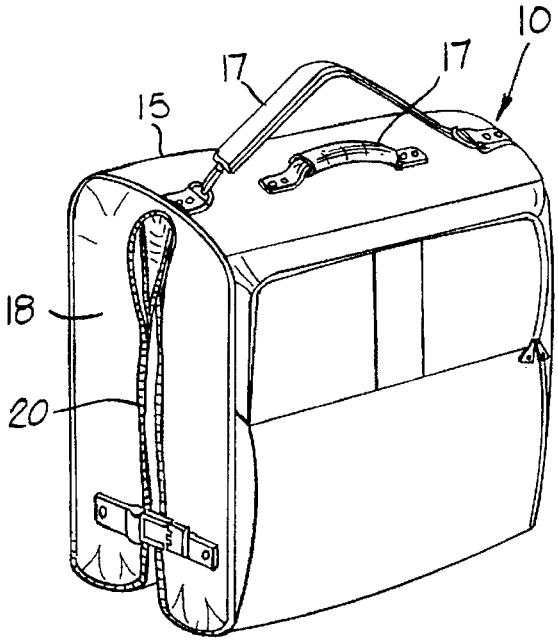
FIG. 4 is the garment bag in the folded or travel condition.

The cylinder-shaped pocket 30 has an axial dimension extending across the width dimension 14 of the garment bag 10, and a circumference dimension large enough to accommodate smaller pieces of clothing. The user may insert these smaller clothing articles into the pocket 30 through the slit opening, which may be secured with access slide zipper 27 (FIG. 2). As shown in FIGS. 2 and 3, the pocket 30 features a broad curving surface protruding into the main packing compartment 12. As mentioned, and as best shown in FIG. 2, the second cylinder-shaped packing compartment 40 is removable from inside the packing compartment 12, with releasable attachment provided by the attaching straps 48. Long garments placed along the forward facing surface of the packing panel 36, and the second packet 40 then reattached with straps 48. FIG. 3 illustrates that releasable attaching straps 38 then may function to hold the panel 36 in its packed condition, after which the slide fasteners 37 may be used to connect the sides of the panel 36 to the corresponding gussets of the garment bag 10. As indicated by FIGS. 1 and 4, when the packing of the bag has been completed, the access panel 13 is zipped shut, and the garment bag 10 is then folded over in the carrying position for carrying the bag by the handle grip or shoulder strap 17.

Figure 4A:
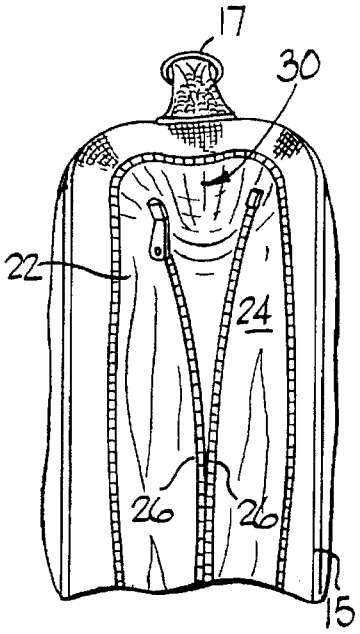
FIG. 4A is a broken-away detail of the upper lefthand corner of FIG. 4.

FIG. 4A shows that the immediately adjacent edges of upper and lower compartments 24 and 22 accommodate the resulting bulge to the outside surface of the access panel caused by the cylinder-shaped pocket 30. The combination thus forms a broadly supporting, gently curving surface over which the hanging garments can be easily draped with little pinching or bunching. The upper edge of the long garment retaining panel 36 extends to just below the lowermost edge of the cylinder-shaped compartment so as not to interfere with this curving surface engaging the hanging garments.

The same smooth folding phenomena of course would apply for the lower ends of the long garments, thanks to pocket 40.

Other configurations embraced by the claims are of course possible. For example, while the cylinder-shaped compartments 30 and 40 are shown to have a general semi-cylindrical shape, that is in cross-section these compartments when packed have a half cylinder shape, other shapes are possible. It is, of course, desired that the surface against which the garments are folded would have a broad, gently curving surface to minimize wrinkling and crushing.

I claim:

1. In a flexible garment bag comprising an access panel hingeably connected to a main packing compartment for receiving hanging garments, said garment bag foldable from an open to a folded position and having an overall width dimension adequate to accommodate the width of the hanging garments and having a height dimension adequate to accommodate the height of the hanging garments, said access panel foldable medially at a fold line at the midpoint of the height dimension and said garment bag having a carrying device such as a handle grip attached across a central portion of said packing compartment at said midpoint of the height dimension, the main packing compartment including a means for holding hangers, and the access panel releasably fastened to the main packing compartment to permit garments on hangers to be inserted into the main packing compartment for transport, the improvement comprising at least one cylindrical shaped packing compartment disposed upon the interior of the access panel and comprising a smoothly curving front surface protruding into said main packing compartment and positioned to engage said smoothly curving surface against at least some of the hanging garments, the cylindrical compartment having an axis extending across the width dimension of the garment bag, and having a circumference dimension large enough to accommodate small pieces of clothing, and having an opening through which such small pieces of clothing may be inserted for transport, wherein the axis of the cylindrical shaped packing compartment extends across said midpoint of the height dimension at the fold line so that the cylindrical shaped packing compartment is positioned substantially symmetrically about the fold line and between the hanging garments and the access panel, with the operable opening being positioned in a side of the cylindrical shaped packing compartment opposite from the access panel, and the hanging garments drape over the cylindrically shaped packing compartment and across the smoothly curving surface when the cylindrical shaped packing compartment is full of small pieces of clothing and the garment bag is in the folded position.

2. A garment bag according to claim 1 wherein the at least one cylindrical shaped packing compartment is fixed to the access panel.

3. A garment bag according to claim 1 further including at least one further cylindrical shaped packing compartment which extends across a lower portion of the main packing compartment.

4. A garment bag according to claim 3 wherein the main packing compartment includes side gussets, and wherein the garment bag further including means for releasably attaching the further cylindrical shaped packing compartment to a side gusset of the main packing compartment and for flexibly attaching the further cylindrical shaped packing compartment to an opposite side gusset, whereby clothes packed in the main packing compartment which are longer than the height dimension of the main packing compartment can have a lower portion thereof looped around the further cylindrical shaped packing compartment.

* * * * *